US006533388B2

(12) United States Patent
Toh et al.

(10) Patent No.: US 6,533,388 B2
(45) Date of Patent: Mar. 18, 2003

(54) SERVICE STATION FOR AN INKJET PRINTER

(75) Inventors: Cher Lek Toh, Singapore (SG); Mu Hua Huang, Taipei (TW); Yang Teh Lee, Taipei (TW); Joo Beng Koh, Singapore (SG); Kan Min Liew, Singapore (SG)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/803,074

(22) Filed: Mar. 9, 2001

(65) Prior Publication Data

US 2002/0126178 A1 Sep. 12, 2002

(51) Int. Cl.[7] ..... B41J 2/165; B41J 29/393
(52) U.S. Cl. ..... 347/33; 347/29
(58) Field of Search ..... 347/33, 32, 24, 347/36, 29, 34

(56) References Cited

U.S. PATENT DOCUMENTS 5,585,826 A * 12/1996 Schroeder et al. ..... 347/32
5,627,574 A 5/1997 Fahy ..... 347/33
5,821,955 A * 10/1998 Waschhauser ..... 347/36
5,847,728 A * 12/1998 Lee ..... 347/33
5,966,146 A * 10/1999 Lee ..... 347/33

FOREIGN PATENT DOCUMENTS

EP 0604067 6/1994 ..... B41J/2/165
EP 0604068 6/1994 ..... B41J/2/165
EP 0653306 5/1995 ..... B41J/2/165
EP 0896881 2/1999 ..... B41J/2/165

* cited by examiner

*Primary Examiner*—Hai Pham

(57) ABSTRACT

The invention relates to a service station for an inkjet printer. The service station includes at least one cap for capping a printhead which is mounted on an inkjet carriage of the inkjet printer. The service station also includes at least one wiper arranged to wipe said printhead carried by the inkjet carriage. The wiper is arranged to move towards and away from the printhead in response to movement of the inkjet carriage so as to enable the printhead to be wiped of any residual ink.

3 Claims, 5 Drawing Sheets

SERVICE STATION FOR AN INKJET PRINTER

FIELD OF THE INVENTION

The present invention relates to a service station in an inkjet printer, and to an inkjet printer incorporating such a service station.

BACKGROUND OF THE INVENTION

The service station of an inkjet printer includes an apparatus for wiping and capping the printheads carried by an inkjet carriage. The wipers are arranged to wipe the residual ink from the printheads after completion of printing. The wiping and capping operations of the service station prevent the printheads from becoming blocked and thereby extend their lives.

U.S. Pat. No. 5,627,574 describes a maintenance device in an inkjet printing apparatus. The maintenance device includes a fixed wiper which is used to wipe residual ink from the printhead. However, as the wiper is fixed it is always in contact with the printhead as the printing carriage enters and leaves the maintenance device. Accordingly, the arrangement of U.S. Pat. No. 5,627,574 is such that the wiper may cause cross contamination of ink in a multiple inkjet printhead system. This is because the wiper would wipe over both printheads and therefore any residual ink from one printhead would be deposited on the other printhead. This greatly impacts on the performance of the inkjet printer. The present invention seeks to address this problem.

SUMMARY OF THE INVENTION

According to a first aspect of the present invention there is provided a service station for an inkjet printer, said service station including at least one cap for capping a printhead which is mounted on an inkjet carriage of said inkjet printer, and at least one wiper arranged to wipe the printhead carried by the inkjet carriage and wherein the wiper is arranged to move towards and away from said printhead in response to movement of the inkjet carriage.

Preferably, said service station includes first and second caps for capping respective first and second printheads. The service station preferably includes first and second wipers arranged to wipe said respective first and second printheads.

In a preferred form of the invention, the service station includes a main frame arranged to be mounted to a chassis of the inkjet printer, a cap frame on which said first and second caps are mounted and a wiper frame on which said first and second wipers are mounted. The cap frame and wiper frame are connected to said main frame in a manner whereby movement of the cap frame results in the movement of said wiper frame to an in-use position in which said first and second wipers can wipe their respective printheads. The wiper frame is preferably arranged to move between a lower or out of use position to an upper or in-use position.

In a preferred form, the cap frame can move both horizontally and vertically relative to said main frame to achieve capping of said first and second printheads. Vertical movement of said cap frame also preferably results in a vertical movement of said wiper frame to said in-use position. Vertical movement of said wiper frame causes said first and second wipers to move from a lower position in which they do not contact their respective printheads to said upper position in which the printheads are wiped by their respective wipers.

The service station preferably includes means to lock the wiper frame in the upper position. The lock means preferably includes a spring biased wiper hook which is arranged to be hingedly connected to the wiper frame. The bias for the wiper hook is preferably provided by a spring connection between a portion of the wiper hook and a portion of the wiper frame.

Release means is preferably provided to release the locking means so that the wiper frame can move from the upper position to the lower position. The release means is preferably activated by the inkjet carriage contacting a release member mounted on the main frame. The release member is preferably an activation arm pivotally mounted on the main frame. The activation arm preferably has a free end arranged to contact said wiper hook when the activation arm is caused to pivot downwardly. Contact of the free end of the activation arm on the wiper hook causes the spring biased wiper hook to disengage from an engagement member on the main frame and to move under the action of the spring bias to the lower position.

A biasing means, preferably in the form of a leaf spring, is located between the main frame and the wiper frame. The leaf spring serving to bias the wiper frame away from the main frame and into the lower position.

Preferably, a blotter is arranged to be mounted on the cap frame so that any ink wiped from the printheads by the wipers is collected by the blotter.

The caps are preferably located on a cap mount which snap fits to the cap frame.

The wipers preferably snap fit onto respective wiper mounts which are integrally formed with the wiper frame.

The cap frame is preferably connected to the chassis or the main frame by a tension spring. The tension spring serving to return the cap frame from a position in which the caps cover their respective printheads to a clear position in which the caps do not cover their respective printheads.

The service station is preferably arranged to be used in an inkjet printer having an inkjet carriage mounted on a shaft. The service station is mounted on a chassis of the printer such that the inkjet carriage can be driven along the shaft and over the service station so as to enable the inkjet carriage to contact a portion of the cap frame. Contact between the inkjet carriage and the portion of the cap frame causes the cap frame to move with the inkjet carriage to a home position. The cap frame is mounted on the main frame in such a manner that contact between the cap frame and the inkjet carriage cause both a substantially horizontal and a substantially vertical change in the positioning of the cap frame relative to the main frame. To this end, the cap frame preferably includes at least one pin extending therefrom which is arranged to be located in a ramp formed in the main frame. Movement of the cap frame due to contact by the inkjet carriage causes the cap frame to move along and up the ramp thereby changing the vertical positioning of the cap frame relative to the chassis as well as its horizontal positioning.

Preferably, the cap frame has two pairs of opposed pins extending therefrom. The pins being arranged to extend from the sides of the cap frame and to move in respective ramps formed in the main frame.

The wiper frame preferably includes at least one pin extending therefrom and arranged to be located within a groove formed in the main frame. The wiper frame pin is preferably arranged to move upwardly in the groove in the main frame as a result of the end of the pin engaging in an aperture formed in the cap frame. Accordingly, said substantially vertical movement of said cap frame during movement of the inkjet carriage to the home position causes said pin of said wiper frame to move upwardly within the groove formed in the main frame.

Preferably, the wiper frame includes two pairs of opposed pins mounted on the sides of the wiper frame, each pin being arranged to be received in a respective groove formed in the main frame.

BRIEF DESCRIPTION OF THE DRAWINGS

An embodiment of the invention will now be described, by way of example only, with reference to the accompanying drawings in which.

DETAILED DESCRIPTION OF THE PREFERRED EMBODIMENT

Figure 1:
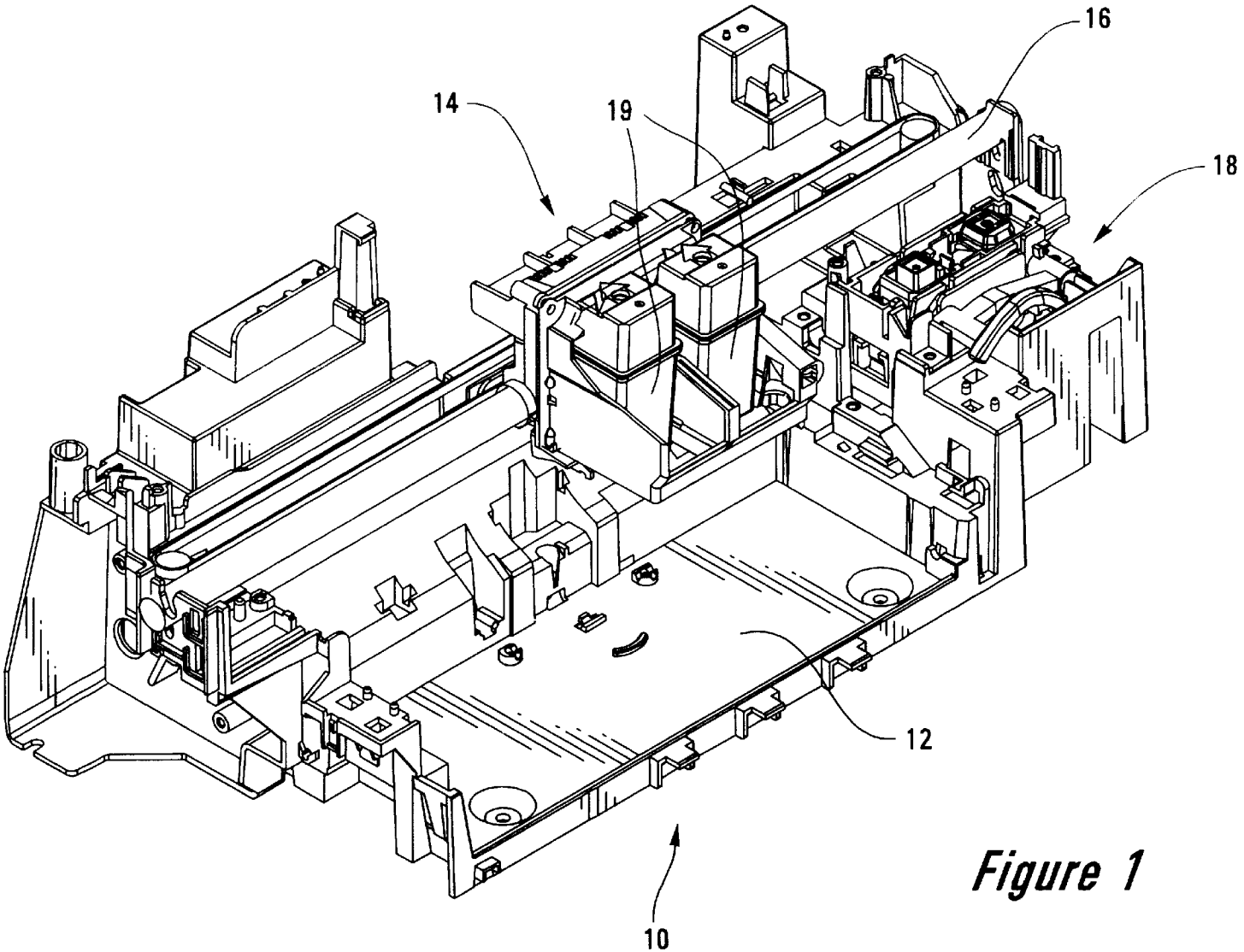
FIG. 1 is a perspective view of an inkjet printer showing a service station in accordance with an embodiment of the invention.

FIG. 1 illustrates an inkjet printer 10 having a chassis 12, an inkjet carriage 14, a shaft 16 and a service station 18. The inkjet carriage 14 is arranged to be driven along the shaft by a motor. The components of the inkjet printer 10 other than the components of the service station 18 are standard within the art.

The inkjet carriage 14 carries a pair of inkjet cartridges 19 each having a printhead 20. When the inkjet printer 10 is not in use, the inkjet carriage 14 is driven along the shaft 16 until it is located above the service station 18. The carriage 14 is located above the service station 18 so that the printheads 20 can be capped by respective caps 22 which are located in the service station 18.

Figure 2:
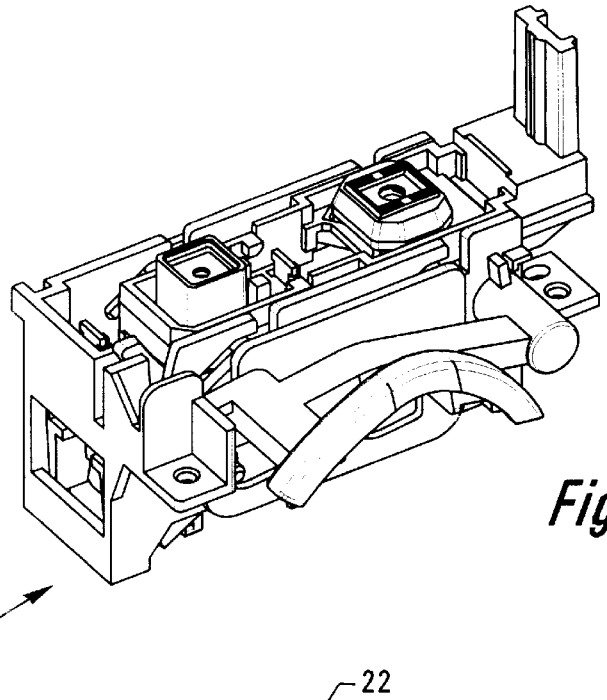
FIG. 2 is a perspective view of the service station shown in FIG. 1.
Figure 3:
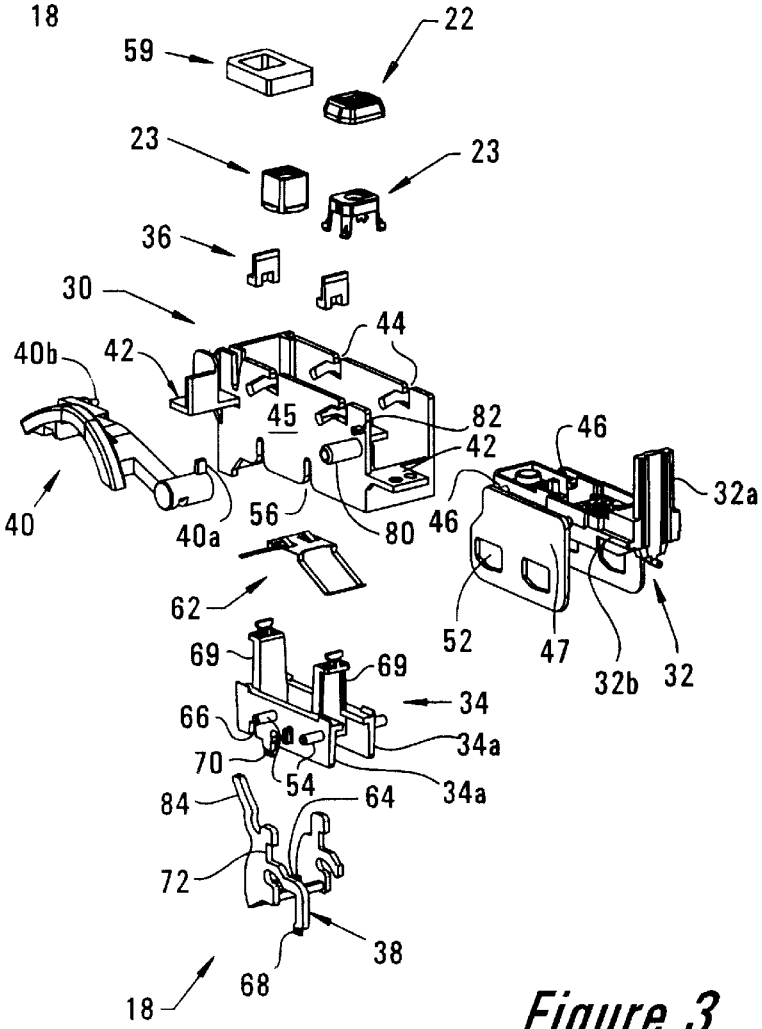
FIG. 3 is an assembly view of the components of the service station shown in FIG. 2.

The components of the service station 18 are best illustrated in FIGS. 2 and 3. As shown in FIG. 3, the service station 18 includes a main frame 30 which is arranged to be mounted to the chassis 12 by a pair of screws (not shown). The service station 18 also includes a cap frame 32 on which the pair of caps 22 are arranged to be mounted and a wiper frame 34 on which a pair of wipers 36 are arranged to be mounted. As will be explained in more detail subsequently, the cap frame 32 and the wiper frame 34 are mounted on the main frame 30 in such a manner that when the inkjet carriage 14 moves into a position above the service station 18 and thereby contacts a portion of the cap frame 32, the cap frame 32 is caused to move in a direction substantially parallel to the longitudinal axis of the shaft 16. In addition to this substantially horizontal movement and during the same operational time, the cap frame 32 is caused to move substantially vertically. In other words, contact between the inkjet carriage 14 and cap frame 32 results in a change in both the horizontal and vertical positioning of the cap frame 32. The inkjet carriage 14 and cap frame 32 will continue to move substantially horizontally until the leading end 14*a* of the inkjet carriage 14 reaches a home position wherein it strikes the end wall 12*a* of the chassis 12.

Movement of the cap frame 32 causes the wiper frame 34 to also move substantially vertically. This results in the wipers 36 moving from a lower position where they are well clear of the printheads 20 to an upper position in which they can contact the printheads 20 of the inkjet carriage 14. The wiper frame 34 is maintained in the upper position by means of a spring-loaded wiper hook 38. The wipers 36 and attached wiper frame 34 are returned to the lower position when the inkjet carriage 14 is caused to contact an activation arm 40 mounted on the main frame 30. This action will be described in more detail below.

The main frame 30 is arranged to be connected to the chassis 12 of the inkjet printer 10 by means of four threaded connectors (not shown) which pass through the mounting points 42. The main frame 30 also includes four ramps 44 which are formed in the side walls 45 of the main frame 30 and are configured to receive respective pins 46 located on the cap frame 32. The ramps 44 are configured so that when the leading end 14*a* of the inkjet carriage 14 contacts the arm 32*a* of the cap frame 32, the cap frame 32 is driven along the ramps 44 resulting in both a horizontal and vertical movement of the cap frame 32. The cap frame 32 and inkjet carriage 14 will move along the shaft 16 until the inkjet carriage 14 reaches the home position.

During the movement of the inkjet carriage 14 to the home position in accordance with a preferred embodiment of the invention, the cap frame 32 is caused to move approximately 8 mm horizontally and 3.8 mm vertically.

The cap frame 32 is arranged to be located on the main frame 30 so that the pins 46 engage within their respective ramps 44. The cap frame 32 also includes side plates 48 which extend downwardly from the body 32*b* of the cap frame 32. Each side plate 48 includes a pair of substantially rectangular shaped apertures 52 which are arranged so that they can receive the respective pins 54 which extend outwardly from the side walls 34*a* of the wiper frame 34. This arrangement of the pins 54 within the apertures 52 is such that when the cap frame 32 moves vertically as a consequence of its contact with the inkjet carriage 14, the pins 54 of the wiper frame 34 are captured within the apertures 52 thereby causing the wiper frame 34 to be moved vertically. The movement of the wiper frame 34 is substantially vertical due to the engagement of the body of the pins 54 within respective elongate grooves 56 formed in the side walls 45 of the main frame 30.

The caps 22 are arranged to be located on cap mounts 23 which snap fit onto the cap frame 32. A blotter 59 to blot any ink stemming from the wipers 36 is also mounted on the cap frame 32.

Extending substantially vertically above the wiper frame 34 are a pair of wiper mounts 69. Each of the wiper mounts are arranged to receive a wiper 36. Each wiper 36 is preferably snap-fitted onto its respective wiper mount 69. The wiper frame 34 is configured so that it can be located within the body of the main frame 30 and so that the pins 54 extend through their respective vertical grooves 56 formed in the main frame 30 and through the apertures 52 formed in the side plates 48 of the cap frame 32.

Figure 6:
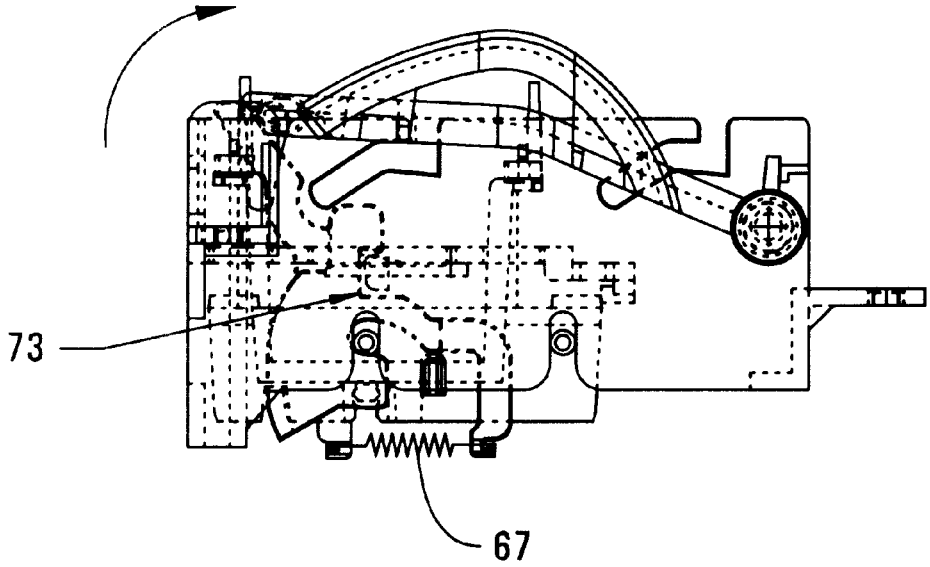
FIG. 6 is a front view showing the wiper hook of the service station in the upper position.
Figure 7:
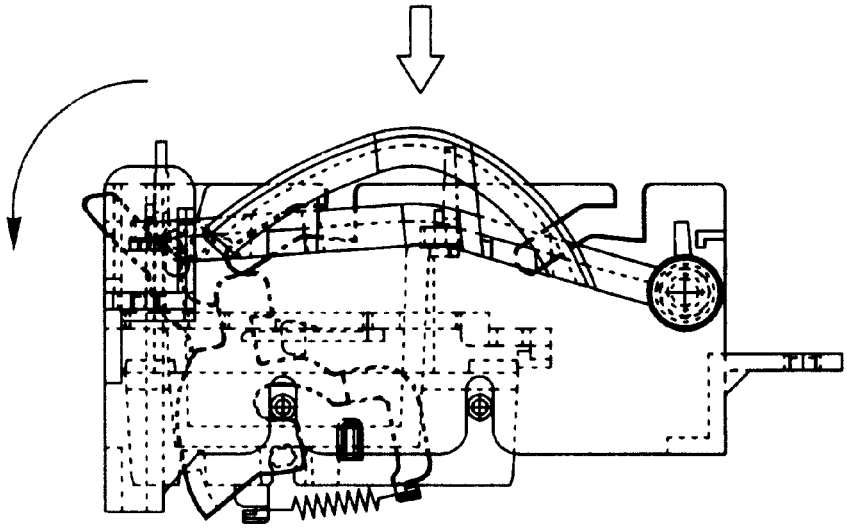
FIG. 7 is a front view similar to that shown in FIG. 6 but with the wiper hook in the lower position.

A leaf spring 62 is sandwiched between the main frame 30 and the wiper frame 34 and tends to push the wiper frame 34 downwardly so as to locate the wipers 36 in the lower position. As stated previously, the wiper hook 38 is provided to lock the wiper frame 34 in the upper position. The wiper hook 38 is configured so that it can be hingedly mounted to the wiper frame 34 by virtue of a hinge pin 64 on the wiper hook 38. Hinge pin 64 is arranged to be located in a pair of opposed seats 66 formed in the wiper frame 34. When the wiper hook 38 is connected to the wiper frame 34 a spring 67 (as shown in FIGS. 6 and 7) is connected between spring connection point 68 on the wiper hook 38 and connection point 70 on the wiper frame 34. The positioning of the pin 64, seats 66 and connection points 68, 70 are such that when the wiper frame 34 is in the upper position the spring 67 tends to rotate the wiper hook 38 in a clockwise direction. This rotation of the wiper hook 38 causes a locking groove 72 formed in the wiper hook 38 to engage about a protrusion 73 formed on the main frame 30. This is best illustrated in FIG. 6. In this manner the wiper frame 34 and attached wipers 36 are maintained in the upper position.

Figure 8:
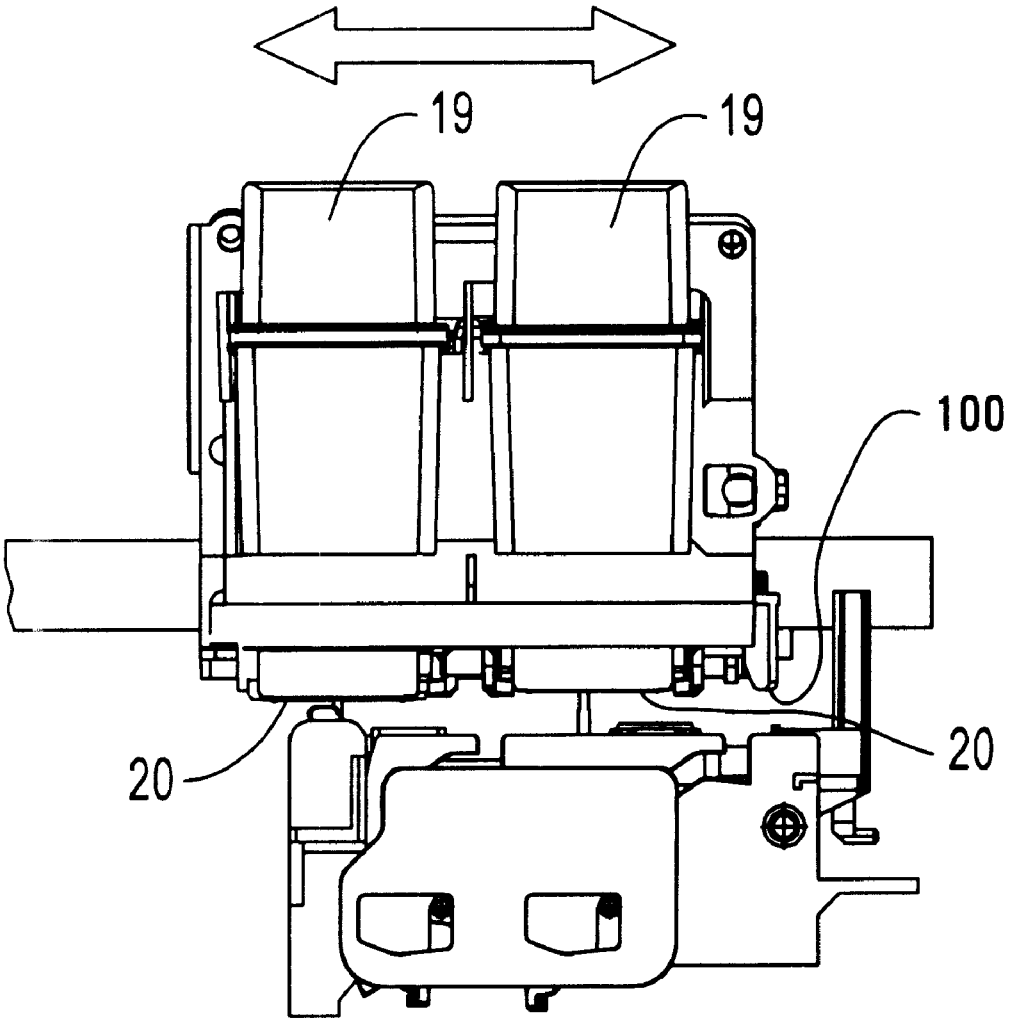
FIG. 8 is a front view showing the wipers in the upper position wiping the printheads carried by the inkjet carriage.

Mounted on the main frame 30 by means of a hinge pin 80 is the activation arm 40. The activation arm 40 is arranged to pivot about the hinge pin 80 until a portion of the activation arm 40*a* contacts against a stop 82 formed on the main frame 30. When the activation arm 40 is caused to pivot due to contact by the inkjet carriage 14, a pin 40*b* formed on the free end of the activation arm 40 is caused to contact against a slant face 84 formed on the wiper hook 38. This contact is sufficient to release the protrusion 73 formed on the main frame 30 from the locking groove 72. Accordingly, the wiper frame 39 under the action of the leaf spring 62 can be returned to the lower position. This movement of the wiper hook 38 is best illustrated in FIG. 7. The downwardly projecting arrow in FIG. 7 represents the pressure applied to the activation arm 40 by the underside of the inkjet carriage 14. The portion 100 of the inkjet carriage 14 which contacts the activation arm 40*a* is shown in FIG. 8.

In accordance with a preferred embodiment of the invention, the inkjet carriage 14 is required to move 22.5 mm along the shaft 16 and away from the home position before it contacts the activation arm 40. This means that when the wiper frame 34 is located in the upper position, the inkjet carriage 14 can move back and forth along the shaft 16 so as to cause the printheads 20 to wipe over their respective wipers 36 provided the inkjet carriage 14 does not move greater than 22.5 mm away from the home position. Once the carriage 14 moves a distance greater than 22.5 mm from the home position contact of the inkjet carriage 14 with the activation arm 40 will cause the wipers 36 to be moved to their lower position. The back and forth motion of the inkjet carriage 14 to wipe the printheads 20 is shown schematically in FIG. 8.

Figure 4:
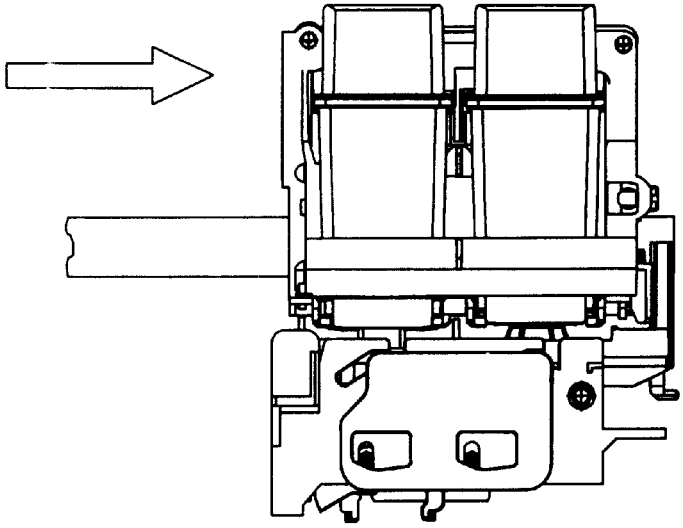
FIG. 4 is a front view showing the inkjet carriage over the service station and the caps capping the printheads carried by the inkjet carriage.
Figure 5:
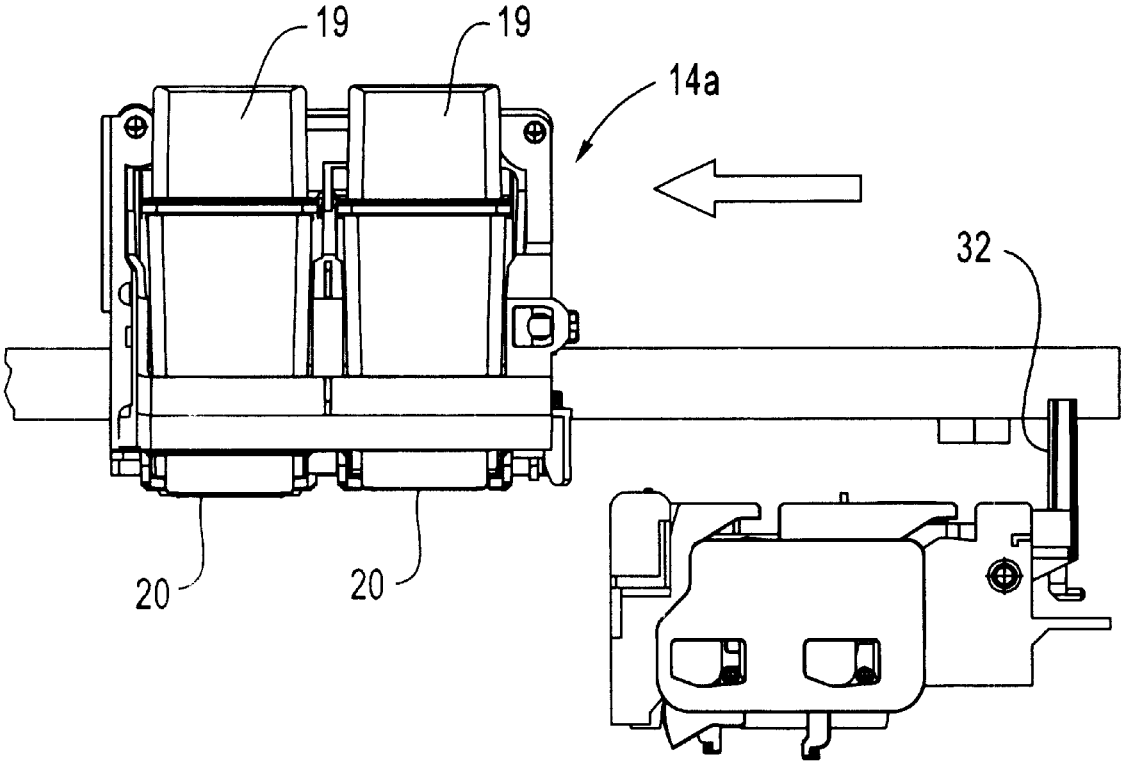
FIG. 5 is a front view showing the inkjet carriage moving away from the service station.

As will be readily appreciated from FIG. 4, the caps 22 are mounted on the cap frame 32 so that when the cap frame 32 is caused to moved vertically upward by virtue of the contact between the arm 32*a* and the inkjet carriage 14, the caps 22 are caused to raise and to engage against the underside of the printheads 20. The wiper hook 38 maintains the wiper frame 34 in the upper position, while the action of the carriage 14 pushing against the cap frame 32 provides sufficient capping force to the caps 22 to ensure a proper seal between them and the end of the printheads 20.

It will be appreciated from the discussion above that the wipers 36 are maintained in their lower position until they are required to wipe the end of the printheads 20. The printheads are only raised to the upper position when the inkjet carriage 14 is positioned relative to the service station 18 so that each respective wiper 36 can only wipe against its respective printhead 20. To explain this in more detail, it should be appreciated that typically the inkjet carriage 14 would carry a first printhead 20 for black ink and a second printhead 20 for coloured ink. Similarly, the wiper frame 34 would carry a first wiper 36 which is arranged to wipe the first printhead and second wiper 36 which is arranged to wipe the second printhead 20. The arrangement of the ramps 44 in the main frame 30 is such that movement of the cap frame 32 is controlled so that the wiper frame 34 is timely raised so that it reaches the upper position once the first printhead (the rightmost printheadas viewed in FIG. 8) has passed above the leftmost wiper on the wiper frame 34. This ensures that there is no cross contamination of the inks as a consequence of any contact between the wipers 36 and printheads 20.

It will also be appreciated by those skilled in the art that the previously described arrangement is simple in its construction and that it does not require a secondary motor to drive the service station 18. Any movement of the components of the service station 18 is a consequence of contact with the inkjet carriage 14 as it is driven by a primary motor (not shown) along the shaft 16.

While the embodiments described herein are preferred, it will be appreciated from the specification that various alternatives, modifications, variations or improvements therein may be made by those skilled in the art are within the scope of the invention, which is defined by the claims.

What is claimed is:

1. A service station for an inkjet printer, said station comprising at least first and second caps for capping respective first and second printheads mounted on an inkjet carriage of the printer, and at least first and second wipers arranged to wipe said respective first and second printheads, and wherein said wipers are arranged to move towards and away from said printheads in response to movement of the inkjet carriage, said service station further comprising a main frame arranged to be mounted to a chassis of the inkjet printer, a cap frame on which said at least first and second caps are mounted and a wiper frame on which said at least first and second wipers are mounted and wherein the cap frame and wiper frame are connected to said main frame in a manner whereby movement of the cap frame results in the movement of said wiper frame to an in-use position in which said at least first and second wipers can wipe their respective first and second printheads, said service station further comprising means to lock the wiper frame in said in-use position, said lock means including a spring biased wiper hook which is arranged to be hingedly connected to the wiper frame, and wherein the bias for the wiper hook is provided by a spring connected between a portion of the wiper hook and a portion of the wiper frame.

2. A service station for an inkjet printer, said station comprising at least first and second caps for capping respective first and second printheads mounted on an inkjet carriage of the printer, and at least first and second wipers arranged to wipe said respective first and second printheads, and wherein said wipers are arranged to move towards and away from said printheads in response to movement of the inkjet carriage, said service station further comprising a main frame arranged to be mounted to a chassis of the inkjet printer, a cap frame on which said at least first and second caps are mounted and a wiper frame on which said at least first and second wipers are mounted and wherein the cap frame and wiper frame are connected to said main frame in a manner whereby movement of the cap frame results in the movement of said wiper frame to an in-use position in which said at least first and second wipers can wipe their respective first and second printheads, said service station further comprising means to lock the wiper frame in said in-use position, said locking means including a spring biased wiper hook which is arranged to be hingedly connected to the wiper frame, release means to release the locking means so that the wiper frame can move from the in-use position to an out of use position, said release means being activated by the inkjet carriage contacting an activation arm pivotally mounted on the main frame.

3. A service station according to claim 2 wherein the activation arm has a free end arranged to contact said wiper hook when the activation arm is caused to pivot downwardly.

* * * * *